US009920897B2

(12) United States Patent
Kim et al.

(10) Patent No.: US 9,920,897 B2
(45) Date of Patent: Mar. 20, 2018

(54) HEAD LAMP FOR VEHICLE

(71) Applicant: SL Corporation, Daegu (KR)

(72) Inventors: Jong Woon Kim, Gyeongbuk-Do (KR); Jong Ryoul Park, Gyeonsangbuk-Do (KR)

(73) Assignee: SL Corporation, Daegu (KR)

( * ) Notice: Subject to any disclaimer, the term of this patent is extended or adjusted under 35 U.S.C. 154(b) by 160 days.

(21) Appl. No.: 14/750,285

(22) Filed: Jun. 25, 2015

(65) Prior Publication Data

US 2016/0003438 A1 Jan. 7, 2016

(30) Foreign Application Priority Data

Jul. 4, 2014 (KR) ..... 10-2014-0083795
May 29, 2015 (KR) ..... 10-2015-0076642

(51) Int. Cl.
*F21S 8/10* (2006.01)

(52) U.S. Cl.
CPC ..... *F21S 48/1715* (2013.01); *F21S 48/1159* (2013.01); *F21S 48/1225* (2013.01); *F21S 48/1323* (2013.01); *F21S 48/1329* (2013.01); *F21S 48/1335* (2013.01); *F21S 48/1376* (2013.01); *F21S 48/1388* (2013.01); *F21S 48/145* (2013.01)

(58) Field of Classification Search
CPC ..... F21S 48/1225; F21S 48/1715
See application file for complete search history.

(56) References Cited

FOREIGN PATENT DOCUMENTS

| | | | |
|---|---|---|---|
| JP | 2009-094014 | A | 4/2009 |
| JP | 2012-129002 | A | 7/2012 |
| JP | 2012-129002 | A | 7/2012 |
| JP | 2014-029775 | A | 2/2014 |

*Primary Examiner* — Elmito Breval
(74) *Attorney, Agent, or Firm* — Mintz Levin Cohn Ferris Glovsky and Popeo, P.C.; Kongsik Kim

(57) ABSTRACT

A head lamp for a vehicle is provided that is capable of irradiating a low beam pattern to the front of the vehicle, without using a separate reflector.

18 Claims, 18 Drawing Sheets

HEAD LAMP FOR VEHICLE

CROSS-REFERENCE TO RELATED APPLICATIONS

This application claims priority to Korean Application No. 10-2014-0083795 filed on Jul. 4, 2014 and Korean Application No. 10-2015-0076642 filed on May 29, 2015, which applications are incorporated herein by reference.

BACKGROUND

1. Field of the Invention

The present invention relates to a head lamp for a vehicle, and more particularly, to a head lamp for a vehicle that provides illumination or a signal to the outside of the vehicle.

2. Description of the Related Art

In general, vehicles have been improved in mobility and usability by the application of advanced technologies. In particular, vehicles are equipped with various vehicle lamps that have an illumination function of confirming an object located in the periphery of the vehicle when the vehicle is being driven at night (e.g., during poor or low lighting conditions), and a signal function for notifying a running state of a subject vehicle to other vehicles and road users.

For example, a head lamp, a fog lamp and the like have an object of the illumination function, and a turn signal lamp, a tail lamp, a brake lamp, a position light and the like have an object of the signal function. Further, such vehicle lamps are defined in the regulations for the installation criteria and standard to fully exhibit the respective functions. To satisfy the regulations of each lamp, the vehicle lamp is designed to include a light source configured to emit light, a reflector configured to refract and reflect the light emitted from the light source, and a lens configured to refract and irradiate the light reflected by the reflector to the outside of the vehicle.

However, due to an interval between the light source and the reflector, an interval between the reflector and the lens or the like, some of the light emitted from the light source disappears without passing through the lens.

SUMMARY

Aspects of the present invention provide a head lamp for a vehicle configured to emit a predetermined beam pattern to the front of the vehicle, without using a separate reflector. The aspects of the present invention are not limited to those mentioned above, and other aspects which are not mentioned will be clearly understood by those skilled in the art from the following description.

According to an aspect of the present invention, a head lamp for a vehicle may include a light source and a lens configured to irradiate light emitted from the light source to the front of the vehicle. In particular, the light source may include a first light source and a second light source; the lens may include a first lens configured to irradiate light emitted from the first light source to the front of the vehicle and a second lens configured to irradiate light emitted from the second light source to the front of the vehicle.

The first lens and the second lens may include a base surface, an incident surface formed to extend from one side of the base surface to form a predetermined angle with the base surface, a first reflection surface formed to extend from the one side (e.g., a first side) of the incident surface to reflect at least a part of light incident through the incident surface to the other side (e.g., a second side) of the incident surface, a second reflection surface to extend from the other side of the base surface toward the front of the vehicle and configured to reflect directly irradiated light of the light incident through the incident surface and reflected light, which is reflected by the first reflection surface, of the light incident through the incident surface toward the front of the vehicle. Additionally, an emission surface formed to extend from the second reflection surface to face the front of the vehicle may be configured to irradiate the direct light and the reflected light reflected by the second reflection surface to the front of the vehicle.

According to another aspect of the present invention, a head lamp for a vehicle may include a plurality of light source modules configured to irradiate a low beam pattern toward the front of a vehicle, wherein the plurality of light source modules may include a first light source module having a plurality of first group light sources configured to emit light, and a first lens configured to irradiate light emitted from the plurality of first group light sources to the front of the vehicle to form a first beam pattern; and a second light source module having a plurality of second group light sources configured to emit light, and a second lens configured to irradiate light emitted from the plurality of second group light sources to the front of the vehicle to form a second beam that at least partially overlaps the first beam pattern.

Further, the first lens may include an incident surface on which the light emitted from the plurality of first group light sources is incident; a first reflection surface that forms a part of a front surface of the first lens and may be configured to reflect the light incident on the inside of the first lens through the incidence surface to the rear side of the first lens. Additionally, an emission surface may be disposed below the first reflection surface and may form a part of the front surface of the first lens. A second reflection surface that forms at least a part of a rear surface of the first lens may be configured to reflect the light reflected by the first reflection surface toward the emission surface. The second lens may include an incident surface on which light emitted from the plurality of second group light sources is incident. In addition, a first reflection surface that forms a part of the front surface of the second lens may be configured to reflect light incident on the inside of the second lens through the incident surface to the rear side of the second lens. An emission surface may be disposed below the first reflection surface and may form a part of the front surface of the second lens and a second reflection surface may form at least a part of the rear surface of the second lens and may be configured to reflect light reflected by the first reflection surface toward the emission surface, and the first beam pattern may be formed at lengthwise direction of the vehicle as compared to the second beam pattern.

According to exemplary embodiments of the present invention, there are at least following effects. It may be possible to irradiate the beam pattern to the front of the vehicle without using a separate reflector. An effect of the present invention is not limited the contents as mentioned above, and further various effects are included herein.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

Figure 1:
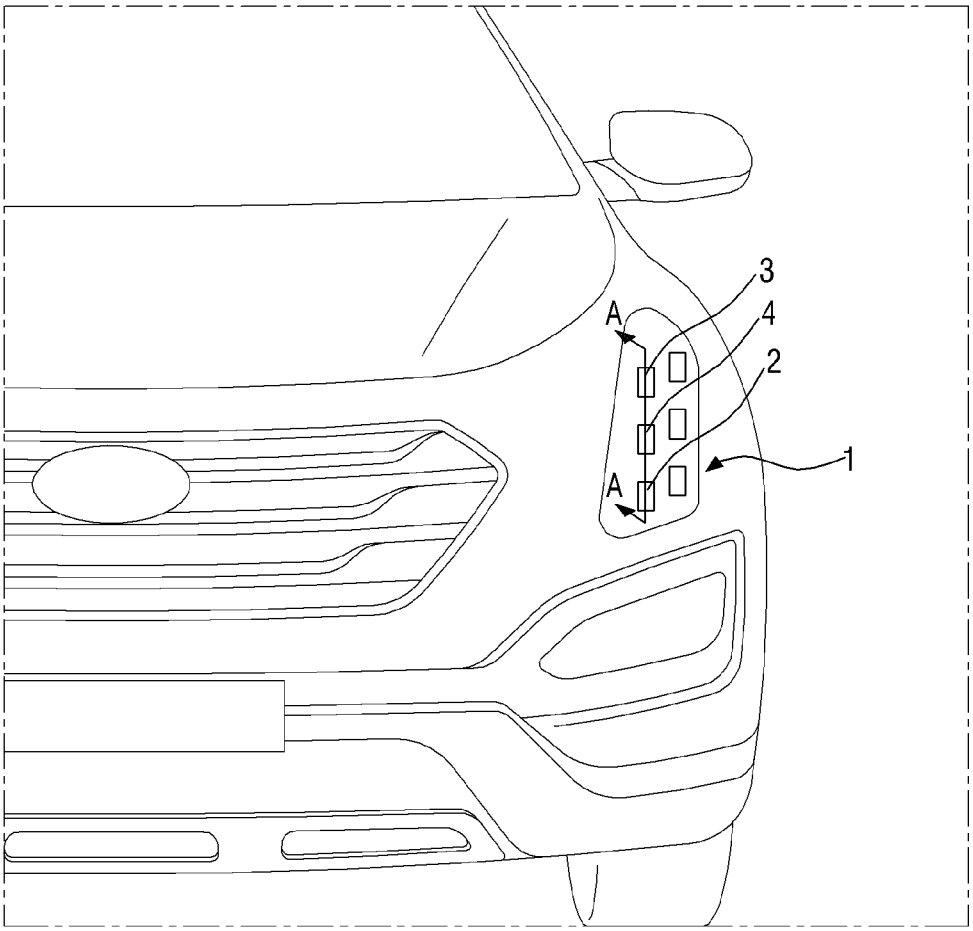
FIG. 1 is a front view schematically illustrating a vehicle in which a head lamp for a vehicle according to an exemplary embodiment of the present invention is installed.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Advantages and features of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the invention to those skilled in the art, and the present invention will only be defined by the appended claims. In the drawings, the thickness of layers and regions are exaggerated for clarity.

Advantages and features of the present invention and a method of achieving them will become apparent when referring to exemplary embodiments that are described below in detail in conjunction with the accompanying drawings. However, the present invention is not limited to the exemplary embodiments set forth herein but can be embodied in many different forms. The exemplary embodiments are merely provided to completely disclose the present invention and to allow a person with ordinary skill in the art to which the invention pertains to fully understand the concept of the invention, and the present invention is only defined by the appended claims. The same reference numerals throughout the specification refer to the same constituent constituents.

Further, the exemplary embodiments described herein will be described with reference to cross-sectional views and/or schematic diagrams as ideal diagrams of the present invention. Therefore, the forms of the diagrams can be modified by manufacturing techniques and/or tolerances. The respective constituent elements in the respective drawings illustrated in the present invention may be illustrated to be slightly enlarged or reduced, in consideration of the convenience of description.

The present invention will be described below with reference to diagrams for illustrating a head lamp for a vehicle according to an exemplary embodiment of the present invention.

FIG. 1 is a front view schematically illustrating a vehicle in which a head lamp for a vehicle according to an exemplary embodiment of the present invention is installed. As illustrated in FIG. 1, a head lamp 1 for a vehicle according to an exemplary embodiment of the present invention may be installed on each of left and right sides of the front of the vehicle and may be configured to form beam patterns such as a low beam pattern and a high beam pattern, based on the running environments of the vehicle, for example, a peripheral brightness, a peripheral vehicle, a road environment, a weather environment or the like.

The head lamp 1 for a vehicle according to an exemplary embodiment of the present invention may include a plurality of light source modules 2 to 7 configured to irradiate a beam pattern toward the front of the vehicle. As illustrated in FIG. 1, a plurality of light source modules may be arranged in two rows in a vertical direction (e.g., longitudinal direction) of the vehicle. However, in certain exemplary embodiments, the plurality of light sources may be arranged in one row or more than two rows in a lateral direction (e.g., horizontal direction) of the vehicle.

As illustrated in FIG. 1, three light source modules 2 to 4 disposed on the inner side the vehicle may be configured to irradiate the low beam pattern toward the front of the vehicle, and the three light source modules 5 to 7 disposed on the outer side of the vehicle may be configured to irradiate the high beam pattern toward the front of the vehicle.

Figure 2:
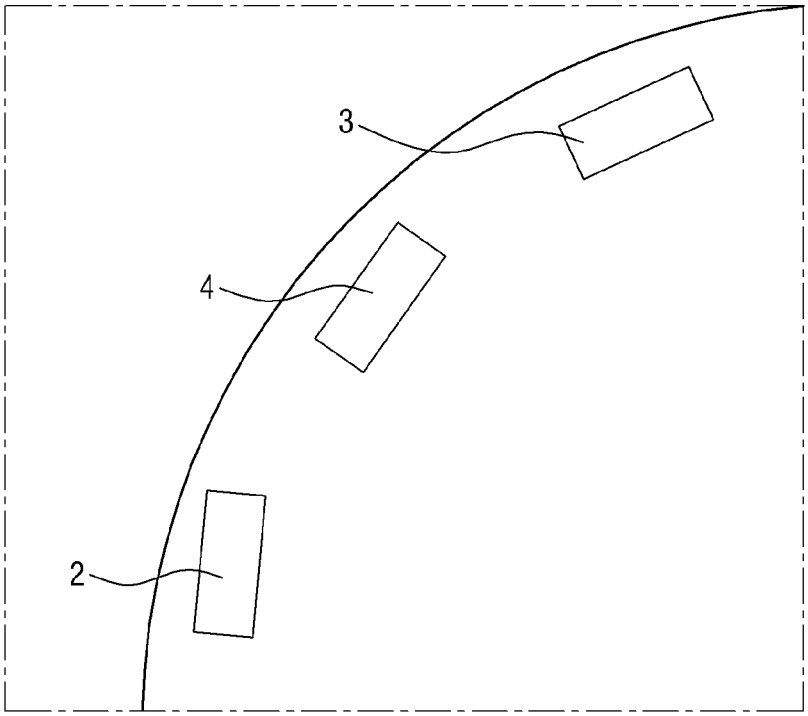
FIG. 2 is a cross-sectional view illustrating a part A-A of FIG. 1 according to an exemplary embodiment of the present invention.

FIG. 2 is a cross-sectional view illustrating a part A-A of FIG. 1. As illustrated in FIG. 2, a first light source module 2 may be disposed below a second light source module 3 and a third light source module 4. Further, the second light source module 3 may be disposed above the first light source module 2 and the third light source module 4. The third light source module 4 may be disposed between the first light source module 2 and the second light source module 3.

An emission surface (14*c*, see FIG. 3) of the second lens may be formed to face the front upper side of the vehicle, as compared to an emission surface (14*a*, see FIG. 3) of the first lens and an emission surface (14*b*, see FIG. 2) of the third lens. The emission surface 14*b* of the third lens may be formed to face the front upper side of the vehicle as compared to the emission surface 14*a* of the first lens. Additionally, the emission surface 14*c* of the second lens may be formed to face the outside of the vehicle, as compared to the emission surface 14*a* of the first lens and the emission surface 14*b* of the third lens. The emission surface 14*b* of the third lens may be formed to face the outside of the vehicle, as compared to the emission surface 14*a* of the first lens. Particularly, an outward direction of the vehicle refers to the lateral direction of the vehicle. For example, in the head lamp installed on the left side of the vehicle, the left side of the vehicle is the outward direction of the vehicle and in the head lamp installed on the right side of the vehicle, the right side of the vehicle is the outward direction of the vehicle.

Figure 3:
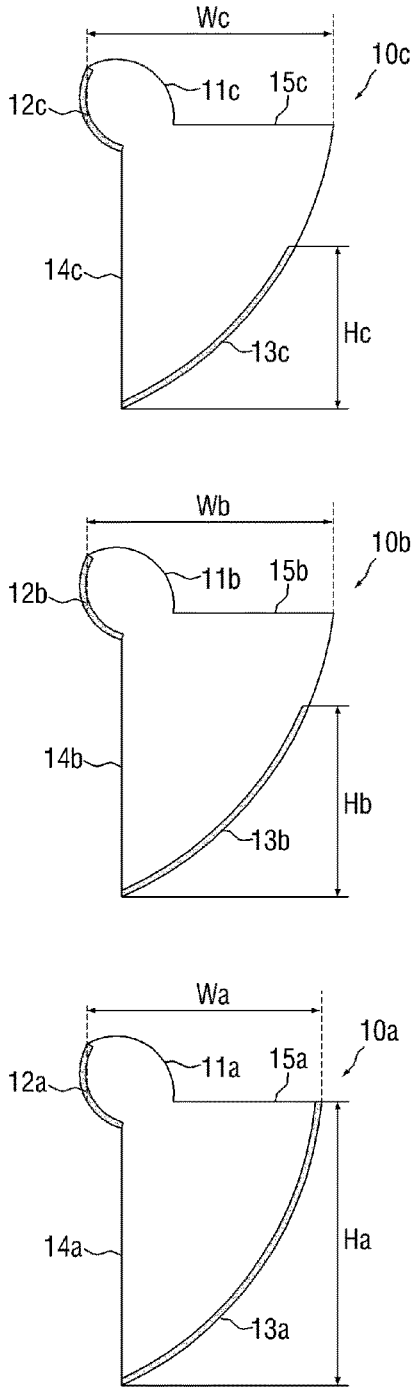
FIG. 3 is a side view schematically illustrating a partial configuration of a head lamp for a vehicle according to an exemplary embodiment of the present invention.
Figure 4:
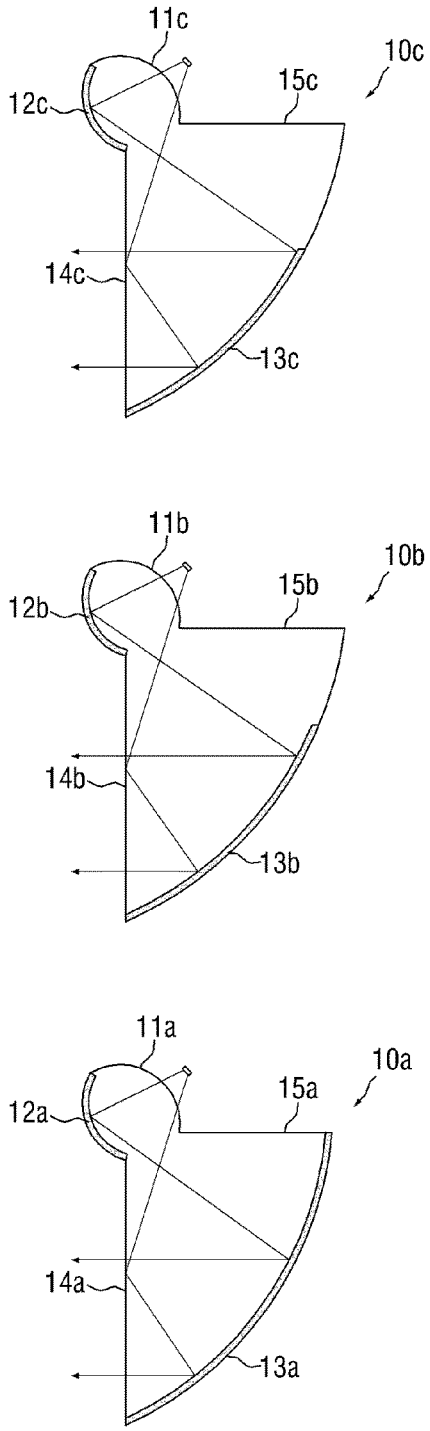
FIG. 4 is a longitudinal sectional view illustrating a head lamp for a vehicle according to an exemplary embodiment of the present invention.
Figure 5:
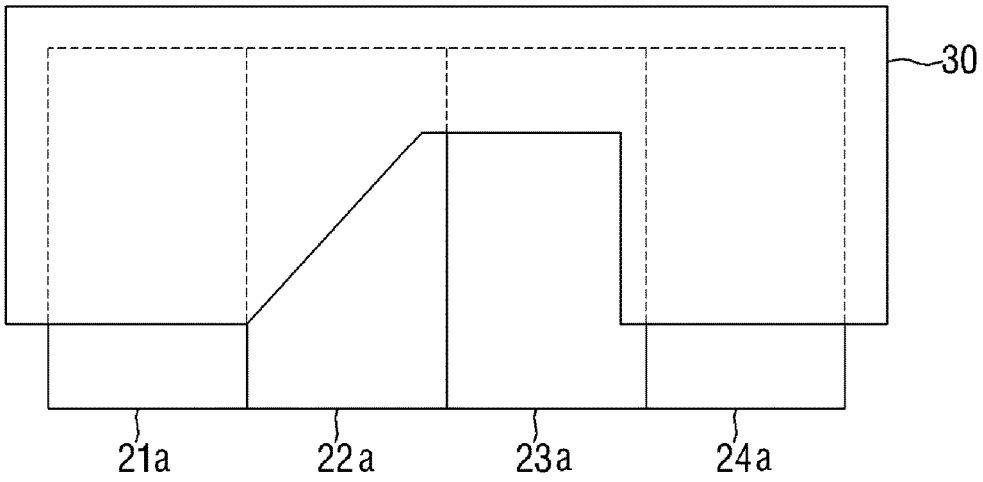
FIG. 5 is a diagram schematically illustrating a plurality of second group light sources and a shield of a second light source module of FIG. 4 according to an exemplary embodiment of the present invention.

FIG. 3 is a side view schematically illustrating a partial configuration of a head lamp for a vehicle according to an exemplary embodiment of the present invention. FIG. 4 is a longitudinal sectional view illustrating a head lamp for a vehicle according to an exemplary embodiment of the present invention. FIG. 5 is a diagram schematically illustrating a plurality of second group light sources and a shield of the second light source module of FIG. 4. As illustrated in FIGS. 3 to 5, a vehicle lamp according to an exemplary embodiment of the present invention may include a plurality of light source modules 2 to 4 which irradiates the low beam pattern.

As illustrated in FIG. 4, the plurality of light source modules 2 to 4 may include a first light source module 2 configured to irradiate a first beam pattern (La, see FIG. 9) toward the front of the vehicle, a second light source module 3 configured to irradiate a second beam pattern (Lb, see FIG. 9) toward the front of the vehicle, and a third light source module 4 configured to irradiate a third beam pattern (Lc, see FIG. 9) toward the front of the vehicle. The first light source module 2 may include a first lens 10*a*, a plurality of first group light sources 20*a* configured to emit light, and a shield 30. As illustrated in FIG. 3, the first light source module 2 may be disposed below the second light source module 3. As will be described below, the first beam pattern La formed in the first light source module 1 may be formed at a lengthwise direction (e.g., from the side) of the vehicle, as compared to the second beam pattern Lb formed in the second light source module 3 (see FIG. 9).

As illustrated in FIGS. 3 to 4, the first lens 10*a* may have an asymmetric shape in the vertical direction and the longitudinal direction (e.g., horizontal or lengthwise direction), and a three-dimensional structure that may include a first base surface 15*a*, an incident surface 11*a*, a first reflection surface 12*a*, a second reflection surface 13*a*, an emission surface 14*a*, and a side surface.

As illustrated in FIG. 3, the first base surface 15*a* and the incident surface 11*a* may form the upper surface of the first lens 10*a*. The incident surface 11*a* may be a surface on which light emitted from the light source is incident. The incident surface 11*a* may extend from the front side of the first base surface 15*a* and may form an upward slope forward with respect to an optical axis of the first lens 10*a*. Additionally, a plurality of first group light sources 20*a* may be disposed above the incident surface 11*a*, and the incident surface 11*a* may protrude toward the plurality of first group light sources 20*a*.

In other words, the incident surface 11*a* may be formed as a curved surface protruding upward. However, in an exemplary embodiment, the incidence surface 11*a* may be formed as a flat plane. Further, the first base surface 15*a* may extend from the rear side of the incident surface 11*a* and may be formed to be substantially parallel to the optical axis of the first lens 10*a*. The rear side of the first base surface 15*a* may be connected to the rear surface of the first lens 10*a*.

As illustrated in FIG. 3, the first reflection surface 12*a* and the emission surface 14*a* may form the front surface of the first lens 10*a*. The first reflection surface 12*a* may form a front upper portion of the first lens 10*a*, and the emission surface 14*a* may form a front lower portion of the first lens 10*a*. The first reflection surface 12*a* and the emission surface 14*a* may be formed to be interconnected. As illustrated in FIG. 3, the first reflection surface 12*a* may be formed as a curved shape protruding to the front of the first lens 10*a*. However, in an exemplary embodiment, the first reflection surface 12*a* may be formed in a generally flat planar shape.

Furthermore, the first reflection surface 12*a* may be formed by deposition of metal layers such as aluminum and chromium with excellent light reflectivity, and light emitted from the plurality of first group light sources 20*a* and incident into the first lens 10*a* through the incident surface

11*a* may be effectively reflected toward the rear surface of the first lens 10*a*. The second reflection surface 13*a* may form at least a part of the rear surface of the first lens 10*a*. As illustrated in FIG. 3, the second reflection surface 13*a* may form the entire rear surface of the first lens 10*a*, but is not limited thereto, and the second reflection surface 13*a* may form a part of the rear surface of the first lens 10*a* (e.g., the rear surface of the first lens 10*a* may have a portion of which is formed by the second reflection surface 13*a*).

The second reflection surface 13*a* may be formed to connect the rear end of the first base surface 15*a* with the lower end of the emission surface 14*a*, and may be configured to reflect light incident on the second reflection surface 13*a* to the emission surface 14*a*. The second reflection surface 13*a* may also be formed by deposition of metal layers such as aluminum and chromium with excellent light reflectivity, and light incident on the second reflection surface 13*a* may be effectively reflected toward the emission surface 14*a*. Further, the second reflection surface 13*a* may have a shape that substantially protrudes rearward.

The emission surface 14*a* and the first reflection surface 12*a* may form the front surface of the first lens 10*a*. In other words, the emission surface 14*a* may form a part of the front surface of the first lens 10*a*. For example, the emission surface 14*a* may form a front lower portion of the first lens 10*a*. The side surface may connect the front surface of the first lens 10*a* with the rear surface of the first lens 10*a*. In other words, the side surface may connect the first reflection surface 12*a* and the emission surface 14*a* with the second reflection surface 13*a*. As described above, since the second reflection surface 13*a* may protrude rearward, the side surface that connects the front surface of the first lens 10*a* with the rear surface of the first lens 10*a* may have a thickness that decreases from the upper side to the lower side.

The plurality of first group light sources 20*a* may be disposed above the first lens 10*a* and may be configured to emit light toward the first lens 10*a*. After light emitted from the plurality of first group light sources 20*a* passes through the shield 30 and the first lens 10*a*, light may be irradiated to the front of the vehicle to form a first beam pattern. The first beam pattern will be described below in detail. The plurality of first group light sources 20*a* may be installed to face the incident surface 11*a* and the front surface of the first lens 10*a*. For example, the plurality of first group light sources 20*a* may be located adjacent to the upper side of the incident surface 11*a*.

As illustrated in FIG. 5, the plurality of first group light sources 21*a*, 22*a*, 23*a*, and 24*a* may include four light sources. Light emitted from the plurality of first group light sources 21*a*, 22*a*, 23*a*, 24*a* may be irradiated to the front of the vehicle through the first lens 10*a* to form a first beam pattern. The plurality of first group light sources 20*a* may be installed to emit light toward the incident surface 11*a*, the emission surface 14*a* and the first reflection surface 12*a*. As a result, the plurality of first group light sources 20*a* may be installed to irradiate light upward and downward with respect to the light source of the first lens 10*a*. As illustrated in FIG. 4, the plurality of first group light sources 20*a* may be disposed above the first lens 10*a* and installed to irradiate light forward to be inclined downward.

Thus, a space for installing a heat sink (not illustrated) may be formed on the upper side of the plurality of first group light sources 20*a*. In particular, the heat sink may be installed above the plurality of first group light sources 20*a* to dissipate heat generated by the plurality of first group light sources 20*a* to the outside. Since the heat sink may be installed above the plurality of first group light sources 20*a*, the heat radiation efficiency of the plurality of first group light sources 20*a* may be improved.

Furthermore, the shield 30 may be disposed above the first lens 10*a* and as illustrated in FIG. 4, may be disposed between the first lens 10*a* and the plurality of first group light sources 20*a*. Thus, the shield 30 may be configured to partially block light emitted from the plurality of first group light sources 21*a*, 22*a*, 23*a*, 24*a* toward the first lens 10*a*. In other words, the shield 30 may be configured to partially block light emitted from the plurality of first group light sources 21*a*, 22*a*, 23*a*, 24*a* toward the first lens 10*a* to form a first beam pattern La. A cut-off edge may be formed in the lower end portion of the shield 30 and thus, a cut-off line may be formed in the first beam pattern.

The second light source module 3 may include a second lens 10*c* and a plurality of second group light sources 20*c* configured to emit light. The second light source module 3 may be disposed above the first light source module 2. In addition, a second beam pattern Lc formed by the second light source module 3 may be formed at a short distance of the vehicle (e.g., within a predetermined distance from the vehicle), as compared to the first beam pattern La formed by the first light source module 2. In other words, the first beam pattern La may be formed at a further distance of the vehicle than the second beam pattern Lc.

As illustrated in FIGS. 3 and 4, a second lens 10*c* may have an asymmetrical shape in the vertical direction and the longitudinal direction, and a three-dimensional structure that may include a first base surface 15*c*, an incident surface 11*c*, a first reflection surface 12*c*, a second reflection surface 13*c*, an emission surface 14*c*, and a side surface. Further, the second lens 10*c* may be configured to irradiate light emitted from the plurality of second group light sources 20*c* to the front of the vehicle to form a second beam pattern Lc that at least overlaps the first beam pattern La of the first light source module 2. Since at least a part of the second beam pattern Lc may overlap the first beam pattern La, a head lamp (1, see FIG. 1) for a vehicle maybe configured to output the low beam pattern (L, see FIG. 9) in the front of the vehicle.

As illustrated in FIG. 3, the first base surface 15*c* and the incident surface 11*c* may form the upper surface of the second lens 10*c*. The incident surface 11*c* is a surface on which light emitted from the light source is incident and the incident surface 11*c* may extend from the front side of the first base surface 15*a*. The incident surface 11*c* may form an upward slope forward with respect to the optical axis of the second lens 10*c*.

Additionally, a plurality of second group light sources 20*c* may be disposed above the incident surface 11*c*, and the incident surface 11*c* may protrude toward the plurality of second group light sources 20*c*. In other words, the incident surface 11*c* may be formed as a curved surface protruding upward. However, in an exemplary embodiment, the incidence surface 11*c* may be formed as a flat plane. The first base surface 15*c* may be substantially parallel to the optical axis of the second lens 10*c* and the rear side of the first base surface 15*c* may be connected to the rear surface of the second lens 10*c*. As illustrated in FIG. 3, the first reflection surface 12*a* and the emission surface 14*a* may form the front surface of the second lens 10*c*. The first reflection surface 12*c* may form a front upper portion of the second lens 10*c*, and the emission surface 14*c* may form a front lower portion of the second lens 10*c*. The first reflection surface 12*c* and the emission surface 14*c* may be interconnected.

As illustrated in FIG. 3, the first reflection surface 12*c* may be formed in a generally curved shape that protrudes to the front of the second lens 10*c*. However, in an exemplary embodiment, the first reflection surface 12*c* may be formed in a generally flat planar shape. Further, the first reflection surface 12*c* may be formed by deposition of metal layers such as aluminum and chromium with excellent light reflectivity, and light emitted from the plurality of second group light sources 20*c* and incident into the second lens 10*c* through the incident surface 11*c* may be effectively reflected toward the rear surface of the second lens 10*c*.

Moreover, the second reflection surface 13*c* may form at least a part of (e.g., a predetermined portion of) the rear surface of the second lens 10*c*. As illustrated in FIG. 3, the second reflection surface 13*c* may form the entire rear surface of the second lens 10*c*, but is not limited thereto, and the second reflection surface 13*c* may form a part of the rear surface of the second lens 10*c*. The second reflection surface 13*c* may formed to connect the rear end of the first base surface 15*c* with the lower end of the emission surface 14*c* to reflect light incident on the second reflection surface 13*c* to the emission surface 14*c*.

The second reflection surface 13*c* may also be formed by deposition of metal layers such as aluminum and chromium with excellent light reflectivity, and light incident on the second reflection surface 13*c* may be effectively reflected toward the emission surface 14*c*. Further, the second reflection surface 13*c* may protrude rearward and the emission surface 14*c* and the first reflection surface 12*c* may form the front surface of the second lens 10*c*. In other words, the emission surface 14*c* may form a part of the front surface of the second lens 10*c*. For example, the emission surface 14*c* may form a front lower portion of the second lens 10*c*, that is, a part or portion of the front surface may be a lower portion thereof.

The side surface (not illustrated) may connect the front surface of the second lens 10*c* with the rear surface of the second lens 10*c*. In other words, the side surface may connect the first reflection surface 12*c* and the emission surface 14*c* to the second reflection surface 13*c*. As described above, since the second reflection surface 13*c* may protrude rearward, the side surface that connects the front surface of the second lens 10*c* to the rear surface of the second lens 10*c* may have a thickness that decreases from the upper side to the lower side.

The plurality of second group light sources 20*c* may be disposed above the second lens 10*c*, and may be configured to emit light toward the second lens 10*a*. After light emitted from the plurality of second group light sources 20*c* passes through the second lens 10*c*, light may be irradiated to the front of the vehicle to form a second beam pattern Lc. The second beam pattern will be described below in detail. The plurality of second group light sources 20*c* may be installed to face the incident surface 11*c* and the front surface of the second lens 10*c*. For example, the plurality of second group light sources 20*c* may be disposed adjacent to the upper side of the incident surface 11*c*.

The plurality of second group light sources 20*c* may be installed to emit light toward the incident surface 11*c*, the emission surface 14*c* and the first reflection surface 12*c*. As a result, the plurality of second group light sources 20*c* may be installed to irradiate light upward and downward with respect to the light source of the second lens 10*c*. As illustrated in FIG. 4, the plurality of second group light sources 20*c* may be disposed above the second lens 10*c* and installed to irradiate light forward to be inclined downward.

Thus, a space for installing a heat sink (not illustrated) may be formed above the plurality of second group light sources 20*c*. The heat sink may be installed above the plurality of second group light sources 20*c* to dissipate heat generated by the plurality of second group light sources 20*c* to the outside. Since the heat sink may be installed above the plurality of second group light sources 20*c*, the heat radiation efficiency of the plurality of second group light sources 20*c* may be improved.

The third light source module 4 may include a third lens 10*b* and a plurality of third group light sources 20*b* configured to emit light. The third light source module 4 may be disposed between the first light source module 2 and the second light source module 3. As illustrated in FIG. 3, the third light source module 4 may be disposed above the first might source module 2 and below the second light source module 3. As illustrated in FIGS. 3 and 4, the third lens 10*b* may have an asymmetrical shape in the vertical direction and the longitudinal direction, and a three-dimensional structure that may include a first base surface 15*b*, an incident surface 11*b*, a first reflection surface 12*b*, a second reflection surface 13*b*, an emission surface 14*b* and a side surface.

Further, the third lens 10*b* may be configured to irradiate light emitted from the plurality of third group light sources 20*b* to the front of the vehicle to form a third beam pattern Lc. At least a part of (e.g., a predetermined portion of) the third beam pattern Lb may overlap the first beam pattern La and the second beam pattern Lc to form the low beam pattern L on the front of the vehicle. As illustrated in FIG. 3, the first base surface 15*b* and the incident surface 11*b* may form the upper surface of the third lens 10*b*. The incident surface 11*b* is a surface on which light emitted from the plurality of third group light sources 20*b* is incident and the incident surface 11*b* may extend from the front side of the first base surface 15*b* and may form an upward slope forward with respect to the optical axis of the third lens 10*b*.

Additionally, a plurality of third group light sources 20*b* may be disposed above the incident surface 11*b*, and the incident surface 11*b* may protrude toward the plurality of third group light sources 20*b*. In other words, the incident surface 11*b* may be formed as a curved surface that protrudes toward the upper side. However, in an exemplary embodiment, the incidence surface 11*b* may be formed as a flat plane. The first base surface 15*b* may be substantially parallel to the optical axis of the third lens 10*b* and the rear side of the third base surface may be connected to the rear surface of the third lens 10*b*.

As illustrated in FIG. 3, the first reflection surface 12*b* and the emission surface 14*b* may form the front surface of the third lens 10*b*. The first reflection surface 12*b* may form a front upper portion of the third lens 10*b*, and the emission surface 14*b* may form a front lower portion of the third lens 10*b*. In particular, the first reflection surface 12*b* and the emission surface 14*b* may be interconnected. As illustrated in FIG. 3, the first reflection surface 12*b* may have curved shape that protrudes to the front of the third lens 10*b*. However, in an exemplary embodiment, the first reflection surface 12*b* may have a flat planar shape.

Further, the first reflection surface 12*b* may have a curved shape that protrudes to the front of the third lens 10*b*. The first reflection surface 12*b* may be formed by deposition of metal layers such as aluminum and chromium with excellent light reflectivity, and light emitted from the plurality of third group light sources 20*b* and incident into the third lens 10*b* through the incident surface 11*b* may effectively reflected toward the rear surface of the third lens 10*b*. The second reflection surface 13*b* may form at least a part of the rear surface of the third lens 10*b*. As illustrated in FIG. 3, the second reflection surface 13*b* may form the entire rear surface of the third lens 10*b*, but is not limited thereto, and the second reflection surface 13*b* may form a part of the rear surface of the third lens 10*b*.

The second reflection surface 13*b* may connect the rear end of the first base surface 15*b* with the lower end of the emission surface 14*b* to reflect light incident on the second reflection surface 13*b* to the emission surface 14*b*. The second reflection surface 13*b* may also be formed by deposition of metal layers such as aluminum and chromium with excellent light reflectivity, and light incident on the second reflection surface 13*b* may effectively reflected toward the emission surface 14*b*. Further, the second reflection surface 13*b* may substantially protrude rearward.

The emission surface 14*b* and the first reflection surface 12*b* may form the front surface of the third lens 10*b*. In other words, the emission surface 14*b* may form a part of the front surface of the third lens 10*b*. For example, the emission surface 14*b* may form a front lower portion of the third lens 10*b*. The side surface (not illustrated) may connect the front surface of the third lens 10*b* with the rear surface of the third lens 10*b*. That is, the side surface may connect the first reflection surface 12*b* and the emission surface 14*b* with the second reflection surface 13*b*. As described above, since the second reflection surface 13*b* may protrude rearward, the side surface that connects the front surface of the third lens 10*b* with the rear surface of the third lens 10*b* may formed with a thickness that decreases from the upper side to the lower side.

The plurality of third group light sources 20*b* may be disposed above the third lens 10*b*, and may be configured to emit light toward the third lens 10*b*. After light emitted from the plurality of third group light sources 20*b* passes through the third lens 10*b*, light may be irradiated to the front of the vehicle to form a third beam pattern Lb. The third beam pattern will be described below in detail. The plurality of third group light sources 20*b* may be installed to face the incident surface 11*b* and the front surface of the third lens 10*b*. For example, the plurality of third group light sources 20*b* may be disposed adjacent to the upper side of the incident surface 11*b*. The plurality of third group light sources 20*b* may be installed to emit light toward the incident surface 11*b*, the emission surface 14*b* and the first reflection surface 12*b*. As a result, the plurality of third group light sources 20*b* may be installed to irradiate light upward and downward with respect to the light source of the third lens 10*b*.

As illustrated in FIG. 4, the plurality of third group light sources 20*b* may be disposed above the third lens 10*b* and installed to irradiate light forward to be inclined downward. Thus, a space for installing a heat sink (not illustrated) may be formed above the plurality of third group light sources 20*b*. The heat sink may be installed above the plurality of third group light sources 20*b* to dissipate heat generated by the plurality of third group light sources 20*b* to the outside. Since the heat sink may be installed above the plurality of third group light sources 20*b*, the heat radiation efficiency of the plurality of third group light sources 20*b* may be improved.

Hereinafter, the height of the second reflection surfaces 13*a* to 13*c* is defined as referring to a separation distance between the upper end and the lower end of the second reflection surfaces 13*a* to 13*c*. Further, the thickness of each of the lenses 10*a* to 10*c* is defined as referring to a maximum separation distance of a separation distance between the rear surfaces of the lenses 10*a* to 10*c* and the front surfaces of the lenses 10*a* to 10*c*. As illustrated in FIG. 3, a height Ha of the second reflection surface 13*a* of the first lens 10*a* may be greater than a height Hc of the second reflection surface 13*c* of the second lens 10*c* and a height Hc of the second reflection surface 13*b* of the third lens 10*b*. Further, the height Hb of the second reflection surface 13*b* of the third lens 10*b* may be greater than the height Hc of the second reflection surface 13*c* of the second lens 10*c*.

As illustrated in FIG. 3, a thickness Wa of the first lens 10*a* may be less than thicknesses Wb, Wc of the second lens 10*c* and the third lens 10*b*. The thicknesses Wb, Wc of the second lens 10*c* and the third lens 10*b* may be about the same. A vertical optical path of light emitted from the respective light sources 20*a*, 20*b* will be described referring to FIG. 4.

As illustrated in FIG. 4, after a part of light (e.g., a first predetermined portion of light) emitted from the respective light sources 20*a*, 20*b* is incident on the inside of the lenses through the incident surfaces 11*a* to 11*c*, the part of light may be reflected by the first reflection surfaces 12*a* to 12*c* toward the second reflection surfaces 13*a* to 13*c*, and reflected again by the second reflection surfaces 13*a* to 13*c* and emitted from the lenses 10*a* to 10*c* through the emission surfaces 14*a* to 14*c*, thereby forming a beam pattern irradiated to the front of the vehicle.

Further, after the other part of light (e.g., a second predetermined portion or light or a remaining portion of light) emitted from the respective light sources 20*a* to 20*c* is incident on the inside of the lenses through the incident surfaces 11*a* to 11*c*, may be reflected by the emission surfaces 14*a* to 14*c* toward the second reflection surfaces 13*a* to 13*c*, and may be reflected again by the second reflection surfaces 13*a* to 13*c* and emitted from the lenses 10*a* to 10*c* through the emission surfaces 14*a* to 14*c*, thereby forming a beam pattern irradiated to the front of the vehicle.

In an exemplary embodiment of the present invention, the emission surfaces 14*a* to 14*c* of each lens may be formed as a substantially flat plane. Thus, the emission surfaces 14*a* to 14*c* of each lens may totally reflect light, which advances toward the emission surfaces 14*a* to 14*c* without being directed to the first reflection surfaces 12*a* to 12*c*, among lights emitted from the respective light sources 20*a* to 20*c* toward the second reflection surfaces 13*a* to 13*c*. However, in an exemplary embodiment, the emission surfaces 14*a* to 14*c* of each lens may be formed as a curved surface having a predetermined curvature.

As illustrated in FIG. 4, among the light emitted from the respective light sources 20*a* to 20*c*, most light reflected by the first reflection surfaces 12*a* to 12*c* and the second reflection surfaces 13*a* to 13*c* and emitted to the emission surfaces 14*a* to 14*c* may be irradiated to the front of the vehicle through the upper portions of the emission surfaces 14*a* to 14*c*. Moreover, among the light emitted from the respective light sources 14*a* to 14*c*, most light reflected by the second reflection surfaces 13*a* to 13*c* and emitted to the emission surfaces 14*a* to 14*c* after totally reflected by the emission surfaces 14*a* to 14*c* may be irradiated to the front of the vehicle through the lower portions of the emission surfaces 14*a* to 14*c*.

As illustrated in FIG. 4, among the light emitted from the respective light sources 20*a* to 20*c*, each light reflected by the first reflection surfaces 12*a* to 12*c* and the second reflection surfaces 13*a* to 13*c* and emitted to the emission surfaces 14*a* to 14*c* may have a minimal reflection angle reflected by the first reflection surfaces 12*a* to 12*c*. Accordingly, the narrow beam pattern may be formed by the light to form a beam pattern having relatively strong luminous intensity.

As illustrated in FIG. 4, among the light emitted from the respective light sources 20*a* to 20*c*, light reflected by the second reflection surfaces 13*a* to 13*c* and emitted to the emission surfaces 14*a* to 14*c* after totally reflected by the emission surfaces 14*a* to 14*c* may have a substantial reflection angle (e.g., a predetermined reflect angle that is greater than the minimal reflection angle) reflected by the emission surfaces 14*a* to 14*c*, the wide beam pattern may be formed by the light to form a beam pattern having relatively weak luminous intensity.

Figure 6:
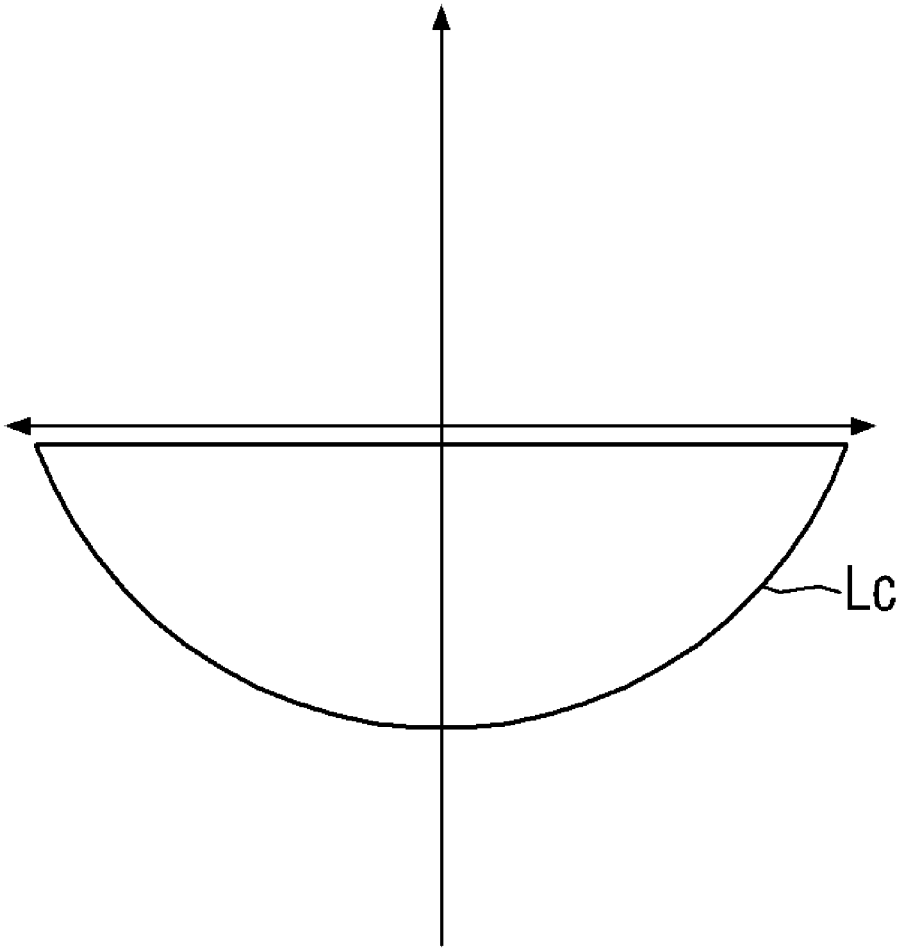
FIG. 6 is a diagram illustrating a first beam pattern that is formed by the first light source module of FIG. 4 according to an exemplary embodiment of the present invention.
Figure 7:
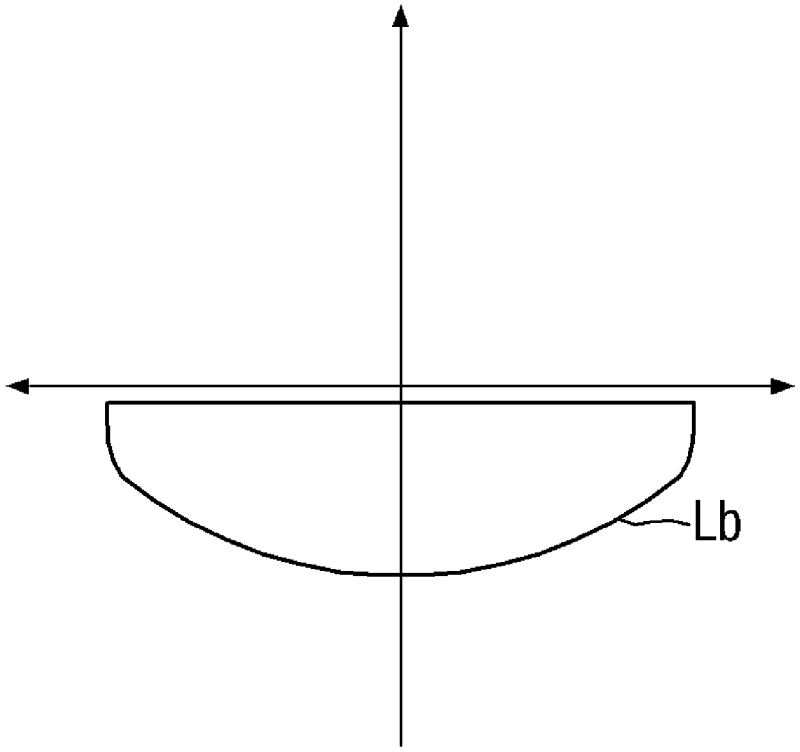
FIG. 7 is a diagram illustrating a second beam pattern that is formed by the second light source module of FIG. 4 according to an exemplary embodiment of the present invention.
Figure 8:
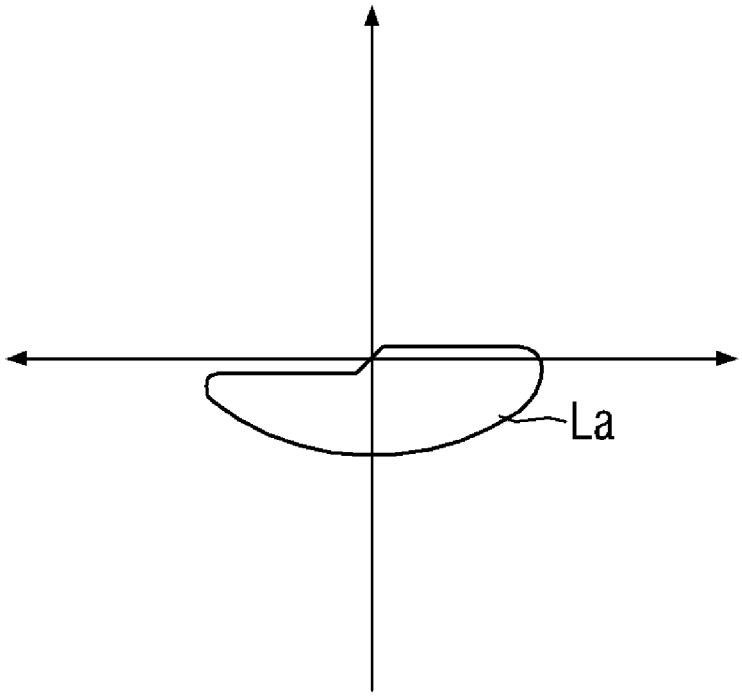
FIG. 8 is a diagram illustrating a third beam pattern that is formed by the third light source module of FIG. 4 according to an exemplary embodiment of the present invention.
Figure 9:
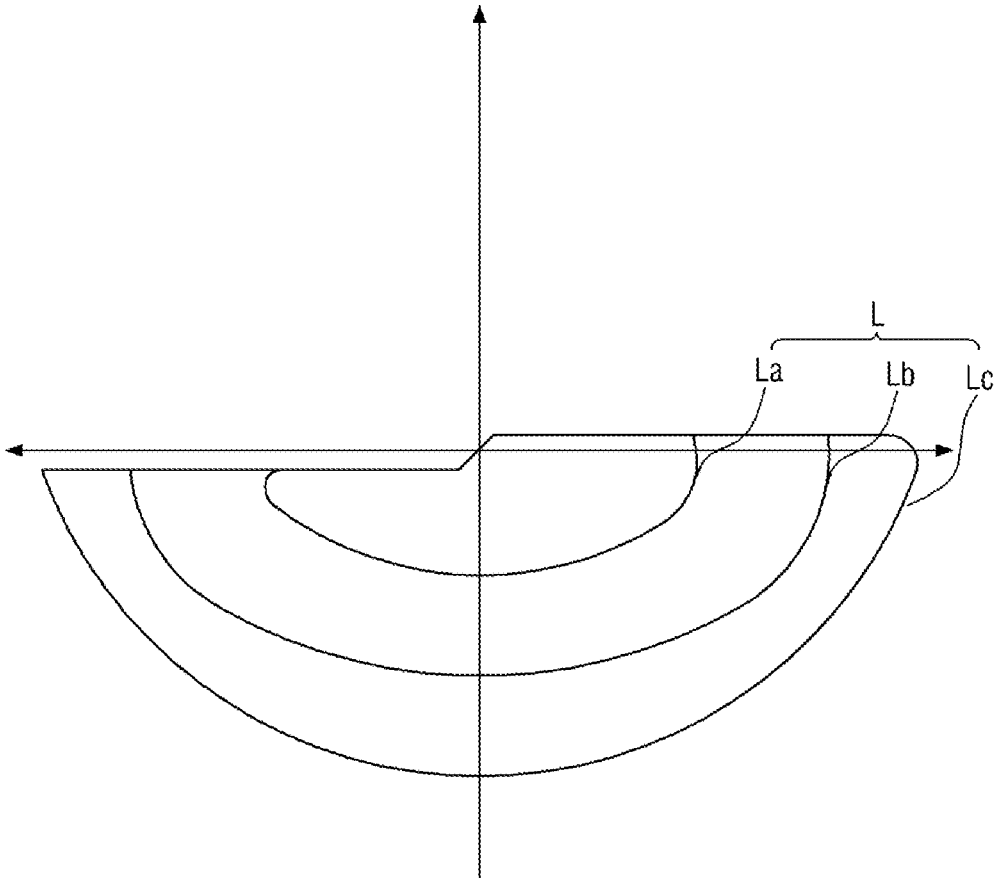
FIG. 9 is a diagram illustrating a low beam pattern that is formed by a head lamp for a vehicle according to an exemplary embodiment of the present invention.

FIG. 6 is a diagram illustrating a first beam pattern formed by the first light source module of FIG. 4. FIG. 7 is a diagram illustrating a second beam pattern formed by the second light source module of FIG. 4. FIG. 8 is a diagram illustrating a third beam pattern formed by the third light source module of FIG. 4. FIG. 9 is a diagram illustrating a low beam pattern formed by a head lamp for a vehicle according to an exemplary embodiment of the present invention. As illustrated in FIGS. 6 to 9, the first light source module (2, see FIG. 4) may form a first beam pattern La irradiated to the front of the vehicle. The second light source module (3, see FIG. 4) may form a second beam pattern Lc irradiated to the front of the vehicle. The third light source module (4, see FIG. 4) may form a third beam pattern Lb irradiated to the front of the vehicle.

As illustrated in FIGS. 6 and 9, the first beam pattern La may include a spot pattern formed at a front long distance of the vehicle (e.g., at a predetermined distance from the vehicle). Additionally, as described above, a shield (30, see FIG. 5) formed with a cut-off edge may be disposed between the plurality of first group light sources (20*a*, see FIG. 4) and the first lens (10*a*, see FIG. 4) of the first light source module 1. Thus, the first beam pattern La may include the cut-off line. Further, the first beam pattern La may be formed at a long distance of the vehicle, as compared to the second beam pattern Lc.

As illustrated in FIGS. 7 and 9, the second beam pattern Lc may include a spread pattern formed at a short distance of the vehicle (e.g., formed at a shorter distance from the vehicle than the first beam pattern La). As illustrated in FIGS. 8 and 9, the third beam pattern Lb may be formed at a shorter distance from the vehicle than the first beam pattern La and at a greater distance from the vehicle than the second beam pattern Lc. Thus, the third beam pattern Lb may be formed as a mid-pattern formed between the spot pattern and the spread pattern (e.g., between the first and second beam patterns).

As illustrated in FIG. 9, the third beam pattern Lb may overlap the first beam pattern La, the second beam pattern Lc may overlap the first beam pattern La and the second beam pattern Lc may overlap the third beam pattern Lb. Thus, the first beam pattern La, the second beam pattern Lc, and the third beam pattern Lb may overlap to form a low beam pattern (L, see FIG. 9) irradiated to the front of the vehicle.

Figure 10:
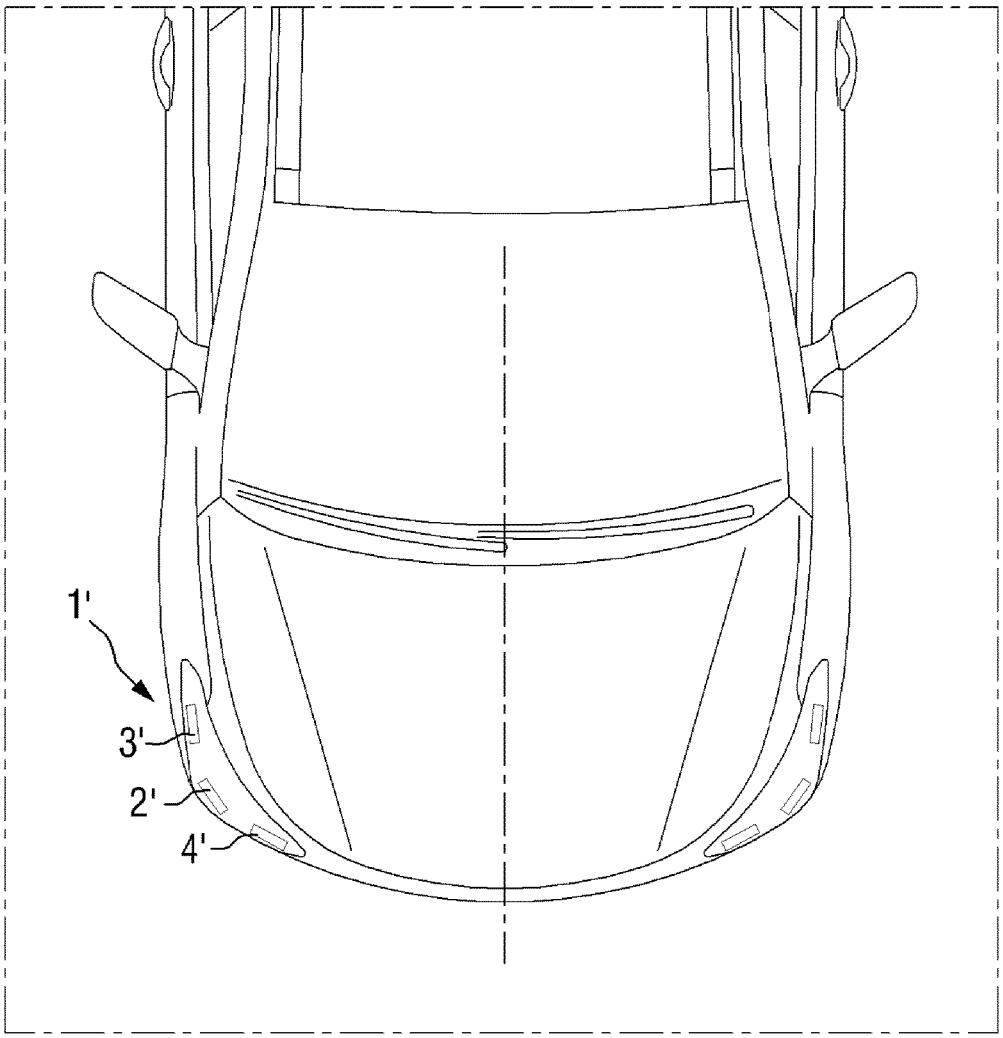
FIG. 10 is a plan view schematically illustrating a vehicle in which a head lamp for a vehicle according to another exemplary embodiment of the present invention is installed.
Figure 11:
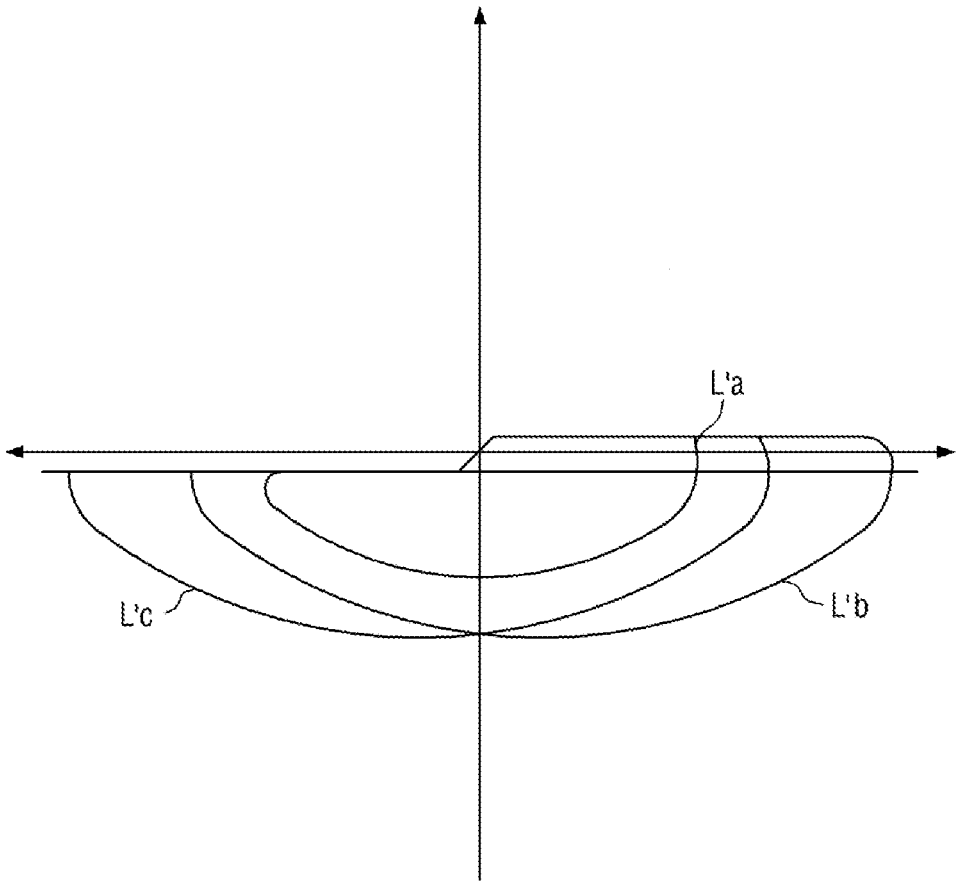
FIG. 11 is a view illustrating a low beam pattern that is formed by a head lamp for a vehicle according to still another exemplary embodiment of the present invention.

FIG. 10 is a plan view illustrating a vehicle in which a head lamp for a vehicle according to another exemplary embodiment of the present invention is installed. FIG. 11 is a diagram illustrating a low beam pattern formed by a head lamp for a vehicle according to another exemplary embodiment of the present invention. As illustrated in FIGS. 10 and 11, a head lamp 1' for a vehicle according to another exemplary embodiment of the present invention may include a plurality of light source modules 2', 3', 4'. The plurality of the light source modules 2', 3 ', 4' of the head lamp 1' installed on the left side of the vehicle may include a first light source module 2', a second light source module 3', and a third light source module 4'.

As illustrated in FIG. 10, the second light source module 3' may be disposed on an outer side of the vehicle and further to the side of the vehicle than the first light source module 2' and the third light source module 4'. The first light source module 2' may be disposed between the second light source module 3' and the third light source module 4'. In other words, the second light source module 3' is disposed furthest to the left side of the vehicle and the third light source module 4' is disposed further toward the front of the vehicle compared to the other lights source modules. In addition, the emission surface of the first lens may be formed to face the outer most side of the vehicle compared to the emission surface of the second lens. The emission surface of the third lens may be formed to face the outer most side of the vehicle compared to the emission surface of the first lens.

In particular, the outward direction of the vehicle refers to the lateral direction of the vehicle. For example, in the head lamp installed on the left side of the vehicle, the left side of the vehicle becomes the outward direction of the vehicle, and in the head lamp installed on the right side of the vehicle, the right side of the vehicle becomes the outward direction of the vehicle.

As illustrated in FIG. 11, a first beam pattern La' formed in the first light source module 2' may include the spot pattern formed at the front long distance of the vehicle and the first beam pattern La' may form a cut-off line. The first beam pattern La' may be formed at a greater distance from the vehicle than the second beam pattern Lc' and the third beam pattern Lb'. As illustrated in FIG. 11, the second beam pattern Lc' formed in the second light source module 3' may include a spread pattern formed at the front short distance of the vehicle (e.g., at a shorter distance from the vehicle than the first beam pattern La'). The third beam pattern Lb' formed in the third light source module 4' may include a spread pattern formed at a front short distance of the vehicle (e.g., at a shorter distance from the vehicle than the first beam pattern La'). However, one of the second beam pattern Lc' and the third beam pattern Lb' may be formed to be eccentric in a right direction compared to the first beam pattern La', and the other of the second beam pattern Lc' and the third beam pattern Lb' may be formed to be eccentric in a left direction compared to the first beam pattern La'.

As illustrated in FIG. 11, when the second beam pattern Lc' and the first beam pattern La' are irradiated onto a screen, the second beam pattern Lc' may be formed to be eccentric in the right direction compared to the first beam pattern La'. In addition, when the third beam pattern Lb' and the first beam pattern La' are irradiated onto the screen, the third beam pattern Lb' may be formed to be eccentric in the left direction, compared to the first beam pattern La'. As illustrated in FIG. 11, the second beam pattern Lc' and the third beam pattern Lb' may overlap the first beam pattern La' on the screen, and the second beam Pattern Lc' and the third beam pattern Lb' may partially overlap each other.

Figure 12:
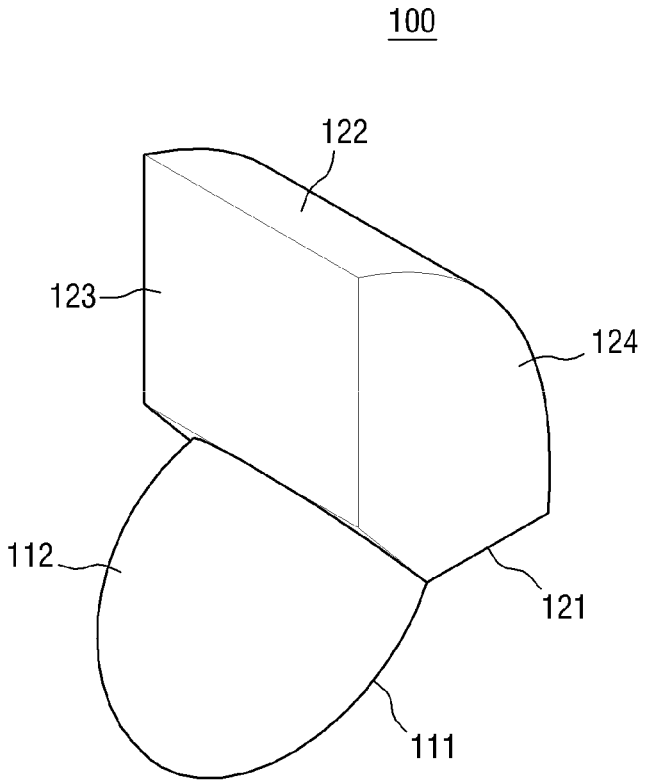
FIG. 12 is a perspective view illustrating a lens of a head lamp for a vehicle according to an exemplary embodiment of the present invention.
Figure 13:
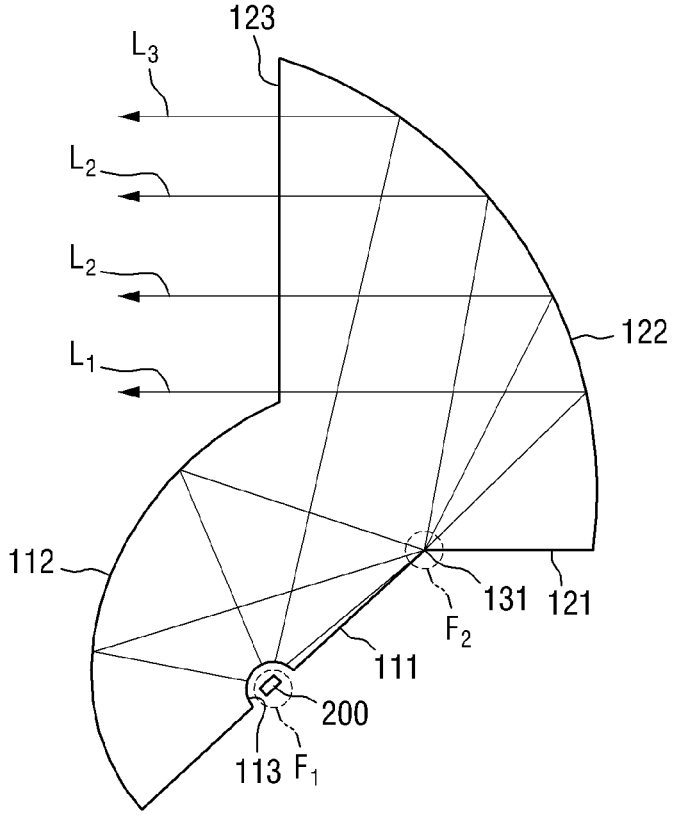
FIG. 13 is a cross-sectional view of the lens of FIG. 11 according to an exemplary embodiment of the present invention.
Figure 14:
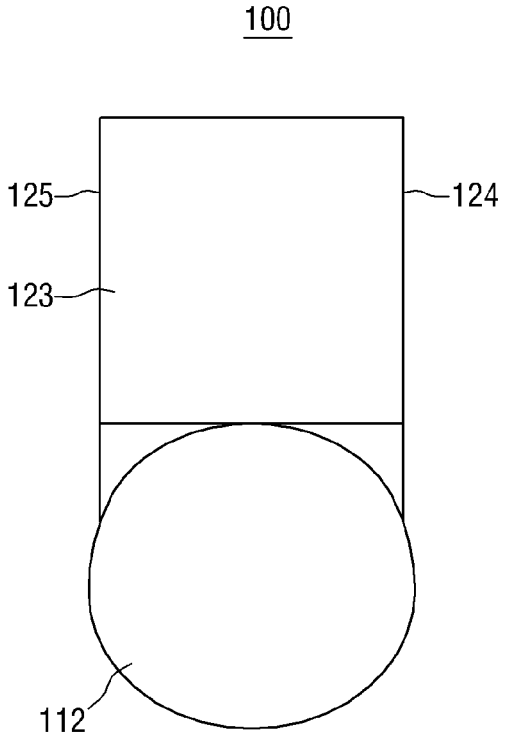
FIG. 14 is a front view of the lens of FIG. 11 according to an exemplary embodiment of the present invention.

FIG. 12 is a perspective view illustrating a lens of a head lamp for a vehicle according to an exemplary embodiment of the present invention, FIG. 13 is a cross-sectional view of the lens of FIG. 11, and FIG. 14 is a front view of the lens of FIG. 11. As illustrated in FIGS. 12 to 14, a lens 100 of a head lamp for a vehicle according to an exemplary embodiment of the present invention has a three-dimensional structure that may include a base surface 121, an incident surface 111, a first reflection surface 112, a second reflection surface 122 and an emission surface 123.

The base surface 121 may be a surface coupled with a support structure (not illustrated) for supporting the lens 100 within a head lamp for a vehicle. The incident surface 111 may be formed to extend from one side (e.g., a first side) of the base surface 121 and may tilt with respect to the base surface 121 at a predetermined angle. A light source installation groove 113 recessed toward the first reflection surface 112 may be formed on the incident surface 111. As illustrated in FIG. 13, a light source 200 may be inserted and installed in the light source installation groove 113. In particular, the light source installation groove 113 may be recessed in a semi-spherical shape to refract and diffuse light emitted from the light source 200 toward the first reflection surface 112.

The first reflection surface 112 may extend from one side (e.g., a first side) of the incident surface 111 toward the rear of the vehicle. A right side is the rear of the vehicle based on FIG. 13. The first reflection surface 112 may be a part of an ellipse in which an installation position of the light source 200 is a first focal point F1 and the other side (e.g., a second side) of the incident surface 111 is a second focal point F2. In this exemplary embodiment, since the light source 200 may be installed within the light source installation groove 113, the first focal point F1 may be disposed in the light source installation groove 113.

Therefore, a part L2 of light (e.g., a first portion L2 of the light) emitted from the light source 200 and incident on the incident surface 111, more specifically, the light source installation groove 113, may be reflected by the first reflection surface 112 and condensed on the other side of the incident surface 111 as the second focal point F2. Additionally, another part L1 of light (e.g., a second portion L1 of the light) emitted from the light source 200 and incident on the light source installation groove 113 may directly advance to the second focal point F2, without being directed to the first reflection surface 112. Further, another part L3 of light (e.g., a third portion L3 of the light) emitted from the light source 200 and incident on the light source installation groove 113, may directly advance to the second reflection surface 122, without being directed to the first reflection surface 112.

Hereinafter, for convenience of explanation, among the light emitted from the light source 200 and incident on the light source installation groove 113, the light L2 reflected by the first reflection surface 112 is referred to as a reflected light. Among the light emitted from the light source 200 and incident on the light source installation groove 113, the light L1 which directly advances to the second focal point F2 without being directed to the first reflected surface 112 is referred to as a first direct light. Among the light emitted from the light source 200 and incident on the light source installation groove 113, the light L3 which directly advances to the second reflection surface 122 without being directed to the first reflection surface 112 is referred to as a second direct light. The first direct light L1 and the second direct light L3 may be collectively referred to as direct light.

Moreover, the other side of (e.g., the second side) the incident surface 111 that corresponds to the position of the second focal point F2 may be a boundary line 13 between the incident surface 111 and the base surface 121. The boundary line 131 between the incident surface 111 and the base surface 121 may block a part of light of the reflected light L2 and the first direct light L1. Therefore, the reflected light L2 and the first direct light L1 may pass through the second focal point F2 and may be partially blocked by the boundary line 131 between the incident surface 111 and the base surface 121, and the unblocked remaining light may advance to the second reflection surface 122.

Figure 15:
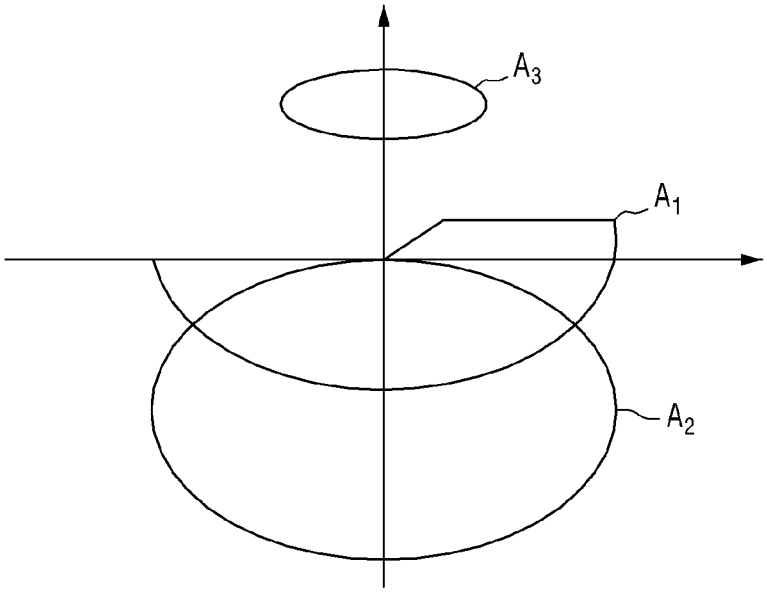
FIG. 15 is a diagram illustrating a low beam pattern irradiated by the lens of FIG. 11 according to an exemplary embodiment of the present invention.

After a part of light is blocked by the boundary line 131 between the incident surface 111 and the base surface 121, the reflected light L2 and the first direct light L1 irradiated to the front of the vehicle through the second reflection surface 122 and the emission surface 123 may form a predetermined low beam pattern (see FIG. 15). In other words, the boundary line 131 may form the cut-off line of the low beam pattern (e.g., may be formed using a cut-off forming unit). Although a shade configured to partially block light emitted from the light source has been separately mounted and utilized to implement a low beam pattern in a conventional head lamp for a vehicle, the lens 100 according to the present exemplary embodiment implements the functions of the conventional shade (e.g., a shield) using the boundary line 131 between the incident surface 111 and the base surface 121.

Therefore, the boundary line 131 between the incident surface 111 and the base surface 121 corresponds to the cut-off line of the low beam pattern, and the shape of the boundary line 131 between the incident surface 111 and the base surface 121 may be substantially similar to the shape of the conventional shade. The shape of the boundary line 131 between the incident surface 111 and the base surface 121 may be variously selected based on the shape of the cut-off line.

Additionally, since the incident surface 111 may tilt with respect to the base surface 121 at a predetermined angle, the boundary line 131 between the incident surface 111 and the base surface 121 may form a peak within the lens 100. Therefore, a part of the reflected light L2 and the first direct light L1 may be refracted upward by the boundary line 131 between the incident surface 111 and the base surface 121 and may be incident on the top of the second reflection surface 122.

Meanwhile, as illustrated in FIGS. 12 and 13, the second reflection surface 122 may extend toward the front of the vehicle from the other side (e.g., a second side) of the base surface 121. In particular, a left side is the front of the vehicle based on the basis of FIG. 13. The second reflection surface 122 may have a shape in which a cross section thereof is a part of a parabola that focuses on the second focal point F2 of the first reflection surface 112. Therefore, the reflected light L2 and the first direct light L1 having passed through the second focal point F2 may be reflected by the second reflection surface 122 and may advance toward the emission surface 123 substantially in parallel.

The second direct light L3 may also be reflected by the second reflection surface 122 and may advance toward the emission surface 123. However, since the second direct light L3 may not advance from the second focal point F2, the second direct light L3 may advance to the reflected light L2 and the first direct light L1 in a non-parallel manner. Since the second direct light L3 is primarily incident on the upper region of the second reflection surface 122, the upper region of the second reflection surface 122 may have a parabolic shape or a curved surface different from the lower region, and it may be possible to form an additional beam pattern that reinforces the low beam pattern using the second direct light L3.

Meanwhile, the emission surface 123 may extend from one end of the second reflection surface 122, and the emission surface 123 may extend approximately vertically downward to face the front of the vehicle. The emission surface 123 may be configured to irradiate the first direct light L1, the second direct light L3 and the reflected light L2 reflected by the second reflection surface 122 to the front of the vehicle. As illustrated in FIGS. 12 to 14, the emission surface 123 may connect the first reflection surface 112 with the second reflection surface 122, and as illustrated in FIGS. 1 and 3, the emission surface 123 may be disposed above the first reflection surface 112.

On either side of the emission surface 123, side surfaces 124, 125 for connecting the emission surface 123 with the second reflection surface 122 may be formed. Although FIGS. 12 and 14 illustrate the side surfaces 124, 125 of the plan shape, the side surfaces 124, 125 may be modified to a curved surface based on design requirements, and the side surface 124, 125 may have a parabolic shape in the form in which the second reflection surface 122 extends.

In the lens 100 of the head lamp for a vehicle according to the present exemplary embodiment, a light-reflective metal layer may be included on the base surface 121, the first reflection surface 112, the second reflection surface 122 and the side surfaces 124, 125, except for the light source installation groove 113 on which light is incident and the emission surface 123 from which light is emitted. Accordingly, light incident from the light source 200 may be prevented from flowing out through the surface other than the emission surface 123. The light-reflective metal layer may be a metal layer such as aluminum and chromium, and the light-reflective metal layer may be deposited on the outer surfaces of the base surface 121, the first reflection surface 112, the second reflection surface 122 and the side surfaces 124, 125, except the emission surface 123.

Meanwhile, FIG. 15 is a diagram illustrating a low beam pattern irradiated by the lens of FIG. 11. As illustrated in FIG. 15, the lens 100 of a head lamp for a vehicle according to an exemplary embodiment of the present invention may be configured to irradiate light emitted from the light source 200 in a low beam pattern. The low beam pattern formed by the lens 100 of the head lamp for a vehicle according to an exemplary embodiment of the present invention may include a long distance pattern A1, a lateral pattern A2 and a signal pattern A3.

In particular, most of the reflected light L2 may be concentrated in about the center of the low beam pattern to form a long distant pattern A1. The long distance pattern A1 is light that reaches the long distance on the road surface on which the vehicle runs (e.g., reaches a predetermined distance from the vehicle). As the reflected light L2 passes through the boundary line 131 between the incident surface 111 and the base surface 121, a part of the light may be blocked to form a beam pattern for forming the cut-off line as illustrated in FIG. 15.

The first direct light L1 may form the long distance pattern A1 together with the reflected light L2 or form the lateral pattern A2 concentrated in the lower portion of the low beam. The lateral pattern A2 is light that reaches a short distance on the road surface on which the vehicle runs (e.g., reaches a distance that is less than the long distance pattern). As the first direct light L1 passes through the boundary line 131 between the incident surface 111 and the base surface 121, a part of the light may also be blocked, and it may be possible to form a cut-off line of the long distant pattern A1 or form a cut-off line of the lateral pattern A2. The second direct light L2 may form the lateral pattern A2 together with the first direct light L1 or may be concentrated in the upper portion of the cut-off line of the low beam pattern, to additionally form a signal pattern A4 that irradiates road sign boards.

As described above, the lens 100 of a head lamp for a vehicle according to an exemplary embodiment of the present invention may form the low beam pattern, using light emitted by the light source 200, without using a separate reflector and a shade (e.g., shield). Since a reflector may be omitted, it may be possible to simplify the structure of the head lamp for a vehicle. Additionally, since the light source 200 and the lens 100 may be installed to be adjacent to each other without using a reflector, the light emitted from the light source 200 is not nearly discarded, and the utilization efficiency of the light source 200 may be improved.

In this exemplary embodiment, although the lens 100 for forming a low beam pattern has been illustrated and described as an example of the use of the lens 100 of the head lamp for a vehicle, the lens may be used in a fog lamp, a day light lamp and a lamp that forms a high beam pattern. The lenses may be modified and designed in accordance with the functions of each lamp and regulations associated therewith.

Figure 16:
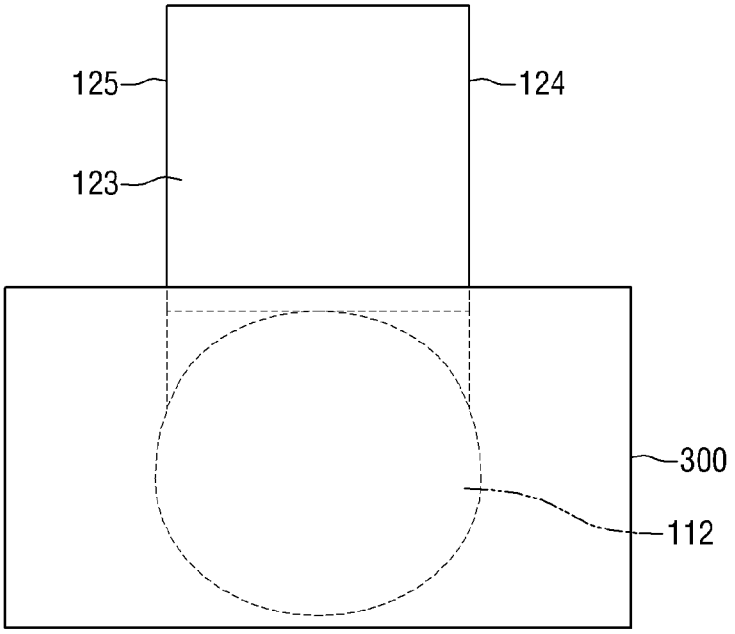
FIG. 16 is a diagram schematically illustrating a head lamp for a vehicle according to an exemplary embodiment using the lens of FIG. 11.

A head lamp for a vehicle which utilizes the above-described lens according to an exemplary embodiment of the present invention will be described below. FIG. 16 is a diagram schematically illustrating a head lamp for a vehicle according to an exemplary embodiment of using the lens of FIG. 11. As illustrated in FIG. 16, a head lamp for a vehicle according to this exemplary embodiment may include a lens 100 and a bezel 300. Although illustrated in FIG. 16, a head lamp for a vehicle according to this exemplary embodiment may also include a light source (200 see FIG. 13) configured to emit light toward the lens 100. As illustrated in FIG. 16, the bezel 300 may be positioned in front of the first reflection surface 112.

As described above, a light-reflective metal layer may be deposited on the outer surface of the first reflection surface 112. Therefore, when viewing the lens 100 from the outside of the vehicle, when there is no bezel 300, the metal layer of the first reflection surface 112 may be visible. Therefore, the bezel 300 may be disposed in front of the first reflection surface 112 to prevent the metal layer formed on the outer surface of the first reflection surface 112 from being visible, thus improving the aesthetics of the head lamp for the vehicle through the design of the bezel 300 and simultaneously the brand identity of the vehicle manufacturer may be expressed.

Figure 17:
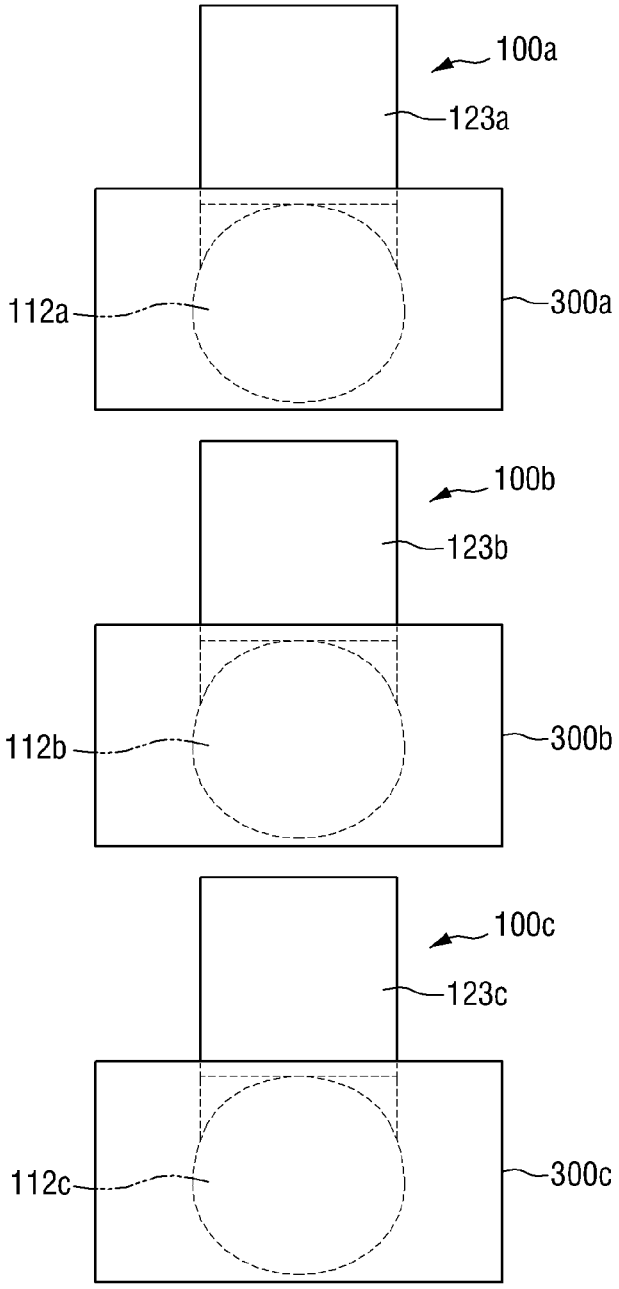
FIG. 17 is a diagram schematically illustrating a head lamp for a vehicle according to another exemplary embodiment using the lens of FIG. 11.

FIG. 17 is a diagram schematically illustrating a head lamp for a vehicle according to another exemplar embodiment using the lens of FIG. 11. As illustrated in FIG. 17, a head lamp for a vehicle according to this exemplary embodiment is an example in which the head lamp for a vehicle according to the embodiment of FIG. 16 is disposed in the vertical direction. When illuminance is insufficient by one lens 100, and when considering the design of the head lamp for a vehicle, a plurality of lenses 100*a*, 100*b*, and 100*c* may be disposed in the vertical direction. Each of bezels 300*a*, 300*b*, and 300*c* may also be disposed in front of the first reflection surfaces 112*a*, 112*b*, 112*c* of each of the lenses 100*a*, 100*b*, and 100*c*.

Figure 18:
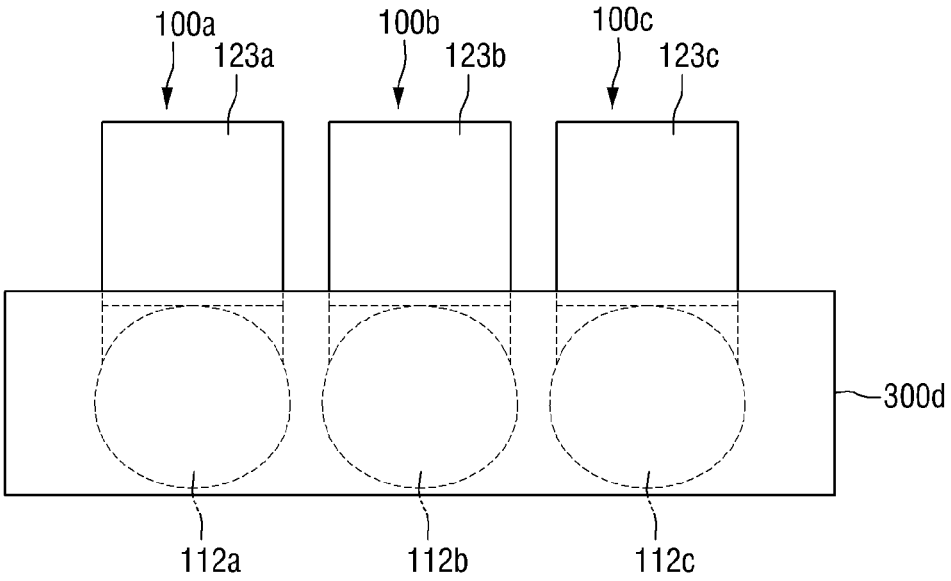
FIG. 18 is a diagram schematically illustrating a head lamp for a vehicle according to still another exemplary embodiment using the lens of FIG. 11.

FIG. 18 is a diagram schematically illustrating a head lamp for a vehicle according to still another exemplary embodiment using the lens of FIG. 11. As illustrated in FIG. 18, a head lamp for a vehicle according to this exemplary embodiment is an example in which a head lamp for a vehicle according to the embodiment of FIG. 16 is disposed in the lateral direction. When illuminance is insufficient by one lens 100, and when considering the design of the head lamp for a vehicle, a plurality of lenses 100*a*, 100*b*, and 100*c* may be disposed in the lateral direction.

As illustrated in FIG. 18, the bezel 300*d* may be formed to cover the first reflection surfaces 112*a*, 112*b*, 112*c* of each of the lenses 100*a*, 100*b*, and 100*c*. Otherwise, although illustrated, the bezel may be divided into a plurality of segments and each of the segments may be disposed in front of the first reflection surfaces 112*a*, 112*b*, 112*c* of each of the lenses 100*a*, 100*b*, 100*c*.

A person having an ordinary skill in the art to which the present invention pertains can understand that the present invention may be embodied in other specific forms without changing the technical spirit or essential characteristics. Therefore, the embodiments described above should be understood as being illustrative rather than restrictive in all aspects. The scope of the present invention is indicated by the claims described below rather than the foregoing detailed description, and it should be construed that all the modifications or variations derived from the meaning and the scope of the claims and the equivalent concepts are included in the scope of the present invention.

In concluding the detailed description, those skilled in the art will appreciate that many variations and modifications can be made to the preferred embodiments without substantially departing from the principles of the present invention. Therefore, the disclosed exemplary embodiments of the invention are used in a generic and descriptive sense only and not for purposes of limitation.

What is claimed is:

1. A head lamp for a vehicle, comprising:

a plurality of light source modules configured to irradiate a low beam pattern toward the front of a vehicle and including:

a first light source module having a plurality of first group light sources configured to emit light, and a first lens configured to irradiate light emitted from the plurality of first group light sources to the front of the vehicle to form a first beam pattern; and a second light source module having a plurality of second group light sources configured to emit light, and a second lens configured to irradiate the light emitted from the plurality of second group light sources to the front of the vehicle to form a second beam pattern that at least partially overlaps the first beam pattern, wherein the first lens includes:

an incident surface on which light emitted from the plurality of first group light sources is incident;

a first reflection surface that forms a part of the front surface of the first lens and is configured to reflect light incident on the inside of the first lens through the incidence surface to the rear side of the first lens;

an emission surface that is disposed below the first reflection surface and forms a part of the front surface of the first lens; and a second reflection surface that forms at least a part of the rear surface of the first lens and is configured to reflect light reflected by the first reflection surface toward the emission surface, wherein the second lens includes:

an incident surface on which light emitted from the plurality of second group light sources is incident;

a first reflection surface that forms a part of the front surface of the second lens and is configured to reflect light incident on the inside of the second lens through the incident surface to the rear side of the second lens;

an emission surface that is disposed below the first reflection surface and forms a part of the front surface of the second lens; and a second reflection surface that forms at least a part of the rear surface of the second lens and is configured to reflect light reflected by the first reflection surface toward the emission surface, and wherein the first beam pattern is formed at a greater distance from the vehicle than the second beam pattern.

2. The head lamp for a vehicle of claim 1, wherein the first light source module further includes a shield configured to block the part of light emitted toward the first lens from the plurality of first group light sources to form the first beam pattern.

3. The head lamp for a vehicle of claim 1, wherein the first lens further includes:

a base surface that connects the incident surface of the first lens with the second reflection surface of the first lens; and a cut-off forming unit disposed between the base surface and the incident surface of the first lens and configured to block a part of light emitted toward the first lens from the plurality of first group light sources to form the first beam pattern.

4. The head lamp for a vehicle of claim 1, wherein a separation distance between an upper end and a lower end of the second reflection surface of the first lens is formed to be greater than a separation distance between an upper end and a lower end of the second reflection surface of the second lens.

5. The head lamp for a vehicle of claim 1, wherein the incident surface of the first lens and/or the incident surface of the second lens is formed to protrude outward.

6. The head lamp for a vehicle of claim 1, wherein at least one of the emission surface of the first lens and the emission surface of the second lens is formed as a plane.

7. The head lamp for a vehicle of claim 1, wherein a maximum separation distance between the front surface and the rear surface of the first lens is formed to be less than a maximum separation distance between the front surface and the rear surface of the second lens.

8. The head lamp for a vehicle of claim 1, wherein the first light source module is disposed below the second light source module.

9. The head lamp for a vehicle of claim 1, wherein the plurality of light source modules further include:

a third light source module having a plurality of third group light sources configured to emit light; and a third lens configured to irradiate light emitted from the plurality of third group light sources to form a third beam pattern, wherein at least a part of the third beam pattern overlaps the first beam pattern and the second beam pattern.

10. The head lamp for a vehicle of claim 9, wherein the first beam pattern is formed at a greater distance from the vehicle than the third beam pattern, and the second beam pattern is formed at a shorter distance from the vehicle than the third beam pattern.

11. The head lamp for a vehicle of claim 9, wherein the first beam pattern is formed at a greater distance from the vehicle than the third beam pattern, one of the second beam pattern and the third beam pattern is formed to be eccentric to a right direction compared to the first beam pattern, and the other of the second beam pattern and the third beam pattern is formed to be eccentric in a left direction compared to the first beam pattern.

12. The head lamp for a vehicle of claim 9, wherein the third lens includes:

an incidence surface on which light emitted from the plurality of the third group light sources is incident;

a first reflection surface that forms a part of the front surface of the third lens and is configured to reflect light incident on the inside of the third lens through the incidence surface to the rear side of the third lens;

an emission surface that forms a part of the front surface of the third lens; and a second reflection surface that forms at least a part of the rear surface of the third lens and is configured to reflect light reflected by the first reflection surface toward the emission surface.

13. The head lamp for a vehicle of claim 12, wherein a separation distance between an upper end and a lower end of the second reflection surface of the first lens is formed to be greater than a separation distance between an upper end and a lower end of the second reflection surface of the third lens, and a separation distance between an upper end and a lower end of the second reflection surface of the third lens is formed to be greater than a separation distance between an upper end and a lower end of the second reflection surface of the second lens.

14. The head lamp for a vehicle of claim 12, wherein a maximum separation distance between the front surface and the rear surface of the first lens is formed to be less than a maximum separation distance between the front surface and the rear surface of the second lens and a maximum separation distance between the front surface and the rear surface of the third lens.

15. The head lamp for a vehicle of claim 9, wherein the first light source module is disposed below the second light source module, and the third light source module is disposed between the first light source module and the second light source module.

16. The head lamp for a vehicle of claim 1, wherein the second light source module is disposed above the first light source module, and the emission surface of the second lens is formed to face the front upper side of the vehicle compared to the emission surface of the first lens.

17. The head lamp for a vehicle of claim 16, wherein the emission surface of the second lens is formed to face the outer side of the vehicle compared to the emission surface of the first lens.

18. The head lamp for a vehicle of claim 1, wherein the second light source module is disposed on the outer most side of the vehicle compared to the first light source module, and the emission surface of the second lens is formed to face the outer most side of the vehicle compared to the emission surface of the first lens.

* * * * *